US008505251B1

(12) United States Patent
Scruggs

(10) Patent No.: US 8,505,251 B1
(45) Date of Patent: Aug. 13, 2013

(54) SYSTEM FOR ROUTING CONDUIT AND RELATED METHODS AND APPARATUS

(76) Inventor: Anthony Keith Scruggs, Orlando, FL (US)

( * ) Notice: Subject to any disclaimer, the term of this patent is extended or adjusted under 35 U.S.C. 154(b) by 0 days.

(21) Appl. No.: 12/565,866

(22) Filed: Sep. 24, 2009

Related U.S. Application Data

(60) Provisional application No. 61/099,788, filed on Sep. 24, 2008.

(51) Int. Cl.
*E04C 2/52* (2006.01)

(52) U.S. Cl.
USPC ..... 52/220.8; 52/742.1

(58) Field of Classification Search
USPC ..... 52/126.1, 126.2, 126.5, 126.6, 126.7, 52/292, 296, 297, 298, 98, 99, 220.1, 220.8, 52/302.3, 741.41, 742.1, 742.13, 742.14; 138/109, 155; 285/230, 219, 136.1, 141.1, 285/143.1
See application file for complete search history.

(56) References Cited

U.S. PATENT DOCUMENTS

| | | | | |
|---|---|---|---|---|
| 4,453,354 | A * | 6/1984 | Harbeke | 52/220.8 |
| 4,785,593 | A * | 11/1988 | Munoz, Jr. | 52/126.1 |
| 4,882,886 | A * | 11/1989 | Harbeke | 52/232 |
| 6,065,160 | A * | 5/2000 | Winn | 4/252.1 |
| 6,101,774 | A * | 8/2000 | Heil | 52/220.8 |
| 6,792,726 | B1 * | 9/2004 | Price | 52/220.8 |
| 7,438,324 | B2 * | 10/2008 | Keiper | 285/31 |
| 7,810,847 | B1 * | 10/2010 | Cornwall | 285/230 |
| 7,877,941 | B2 * | 2/2011 | Fischer et al. | 52/220.8 |

* cited by examiner

*Primary Examiner* — Jessica Laux
(74) *Attorney, Agent, or Firm* — Allen, Dyer, Doppelt, Milbrath & Gilchrist, P.A.

(57) ABSTRACT

An adapter with a female portion in connected to a conduit extension at a location within a barrier. The female portion can include female threads that extend beyond the barrier. Alternately, a modular adapter including an adapter element and elongated element can be releasably connected to the female portion with the elongated element extending beyond the barrier. Conduit damage proximate to the barrier is repaired by removing a damaged portion extending beyond the barrier and connecting a male adapter to the female portion.

4 Claims, 6 Drawing Sheets

SYSTEM FOR ROUTING CONDUIT AND RELATED METHODS AND APPARATUS

CROSS-REFERENCE TO RELATED APPLICATION

This application claims the benefit U.S. Provisional Application Ser. No. 61/099,788, filed on Sep. 24, 2008, the contents of which application are hereby incorporated by reference in their entirety.

FIELD OF THE INVENTION

The present invention relates to conduit routed through barriers, and particularly, to service conduit extending through foundation slabs.

BACKGROUND OF THE INVENTION

In many areas, standard construction techniques include forming a structure's foundation directly on the underlying ground. The ground is leveled, framework is erected at edges of the foundation, and concrete is poured onto the ground within the framework. This is commonly referred to as a "slab-on-grade" foundation.

One challenge of "slab-on-grade" and similar foundations is that services, such as electric, telephone, cable, water, sewer and natural gas, must be routed before laying the foundation. Referring to FIG. 1, to aid in routing, and to protect and insulate the services from the ground, subcontractors responsible for the various services typically lay out conduit 210 (e.g., polyvinyl chloride (PVC) pipe) with a vertical extension 212 where the services are to penetrate the slab. The slab 214 is then poured over the conduit 210, with the vertical extensions 212 extending above the slab 214 for ready access by the subcontractors, who can then further extend the conduit 210 to a desired location within the structure as construction proceeds.

However, construction sites are busy places, with the subcontractors often rushing to meet deadlines, and heavy equipment and vehicles frequently passing over the slab. As a result, referring to FIG. 2, damaging or breaking of the vertical extension 212 is common occurrence. If a break 216 or other damaged point is too close to the slab 214, the subcontractor is left with insufficient conduit to add a further extension.

To remedy this situation, referring to FIG. 3, the subcontractor must remove concrete from the slab 214 in an area 220 surrounding the vertical extension 212 to expose more of the vertical extension 212. Referring to FIG. 4, the subcontractor can then cut the vertical extension 212 level and install a coupling 222 to permit the addition of a further extension 224. A filler 230 is typically employed to fill-in the area 220.

While the foregoing is an effective repair, it is relatively time-consuming to chip away concrete from the slab 214 to expose the necessary length of the vertical extension 212, as well as to add the necessary filler 230. On even a relatively-modest residential construction project, a given subcontractor may be responsible for a dozen or more vertical extensions; on a large-scale commercial or industrial project, there can be hundreds of vertical extensions. Since it is commonplace for at least some of the vertical extensions to be damaged, the requisite repair can consume a significant amount of time and effort.

SUMMARY OF THE INVENTION

In view of the foregoing, it is an object of the present invention to provide an improved system for routing conduit through barriers, and related methods and apparatus.

According to an embodiment of the present invention, an adapter with a female portion in connected to a conduit extension at a location within a barrier. The female portion can include female threads which extend beyond the barrier. Alternately, a modular adapter including an adapter element and elongated element can be releasably connected to the female portion with the elongated element extending beyond the barrier.

According to a method aspect of the present invention, a method of routing conduit through a barrier includes positioning a conduit extension such that the extension will extend into the barrier and connecting a first adapter with female threads to the conduit extension such that the connection between the adapter and the conduit and at least a portion of the female threads will be located within the barrier and available to receive a second adapter with male threads.

According to another method aspect, a method of repairing conduit damage proximate to a barrier includes removing a damaged portion of a conduit adapter, and connecting a male adapter to a female portion located at least partially within the barrier.

These and other objects, aspects and advantages of the present invention will be better appreciated in view of the drawings and following description of preferred embodiments.

DETAILED DESCRIPTION OF PREFERRED EMBODIMENTS

Figure 1:
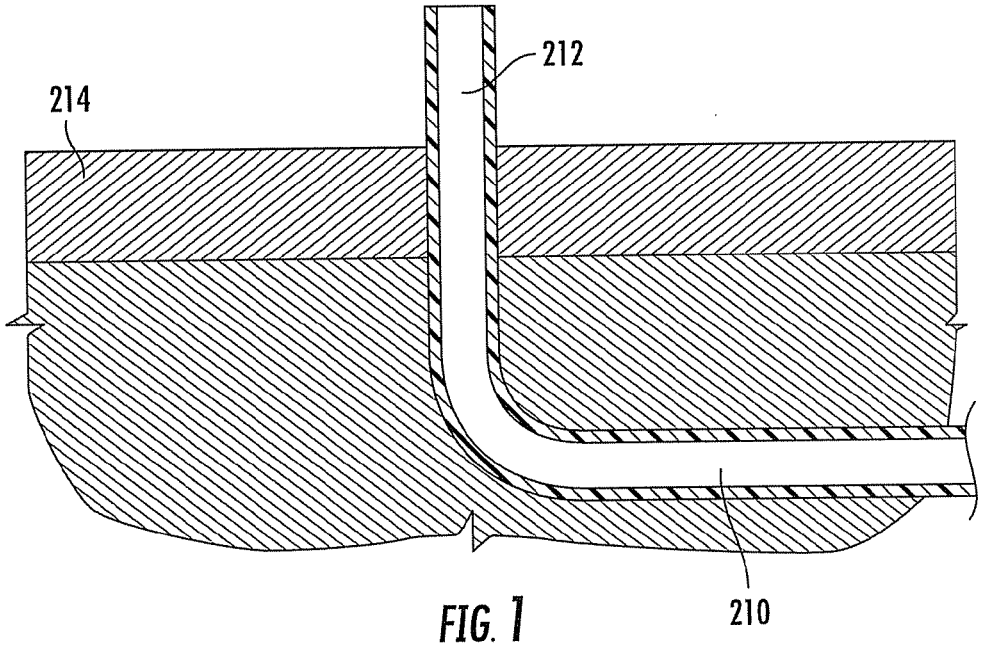
FIG. 1 is a sectional view of conduit with a vertical extension extending through a slab.
Figure 2:
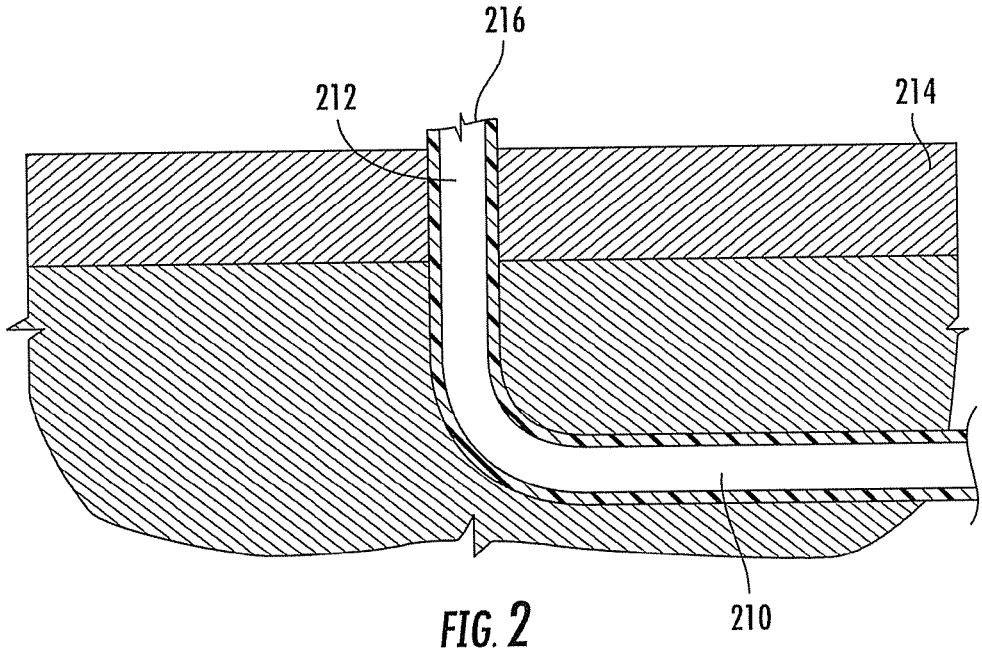
FIG. 2 is a sectional view of the conduit of FIG. 1, with the vertical extension broken proximate to the slab.
Figure 3:
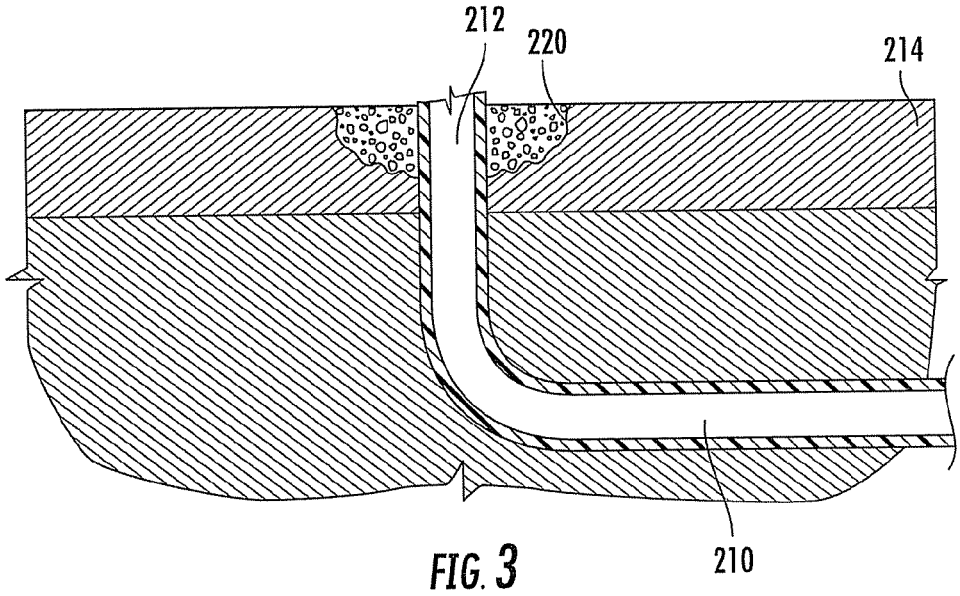
FIG. 3 is a sectional view of the conduit of FIG. 1, with an area of the slab removed surrounding the vertical extension.
Figure 4:
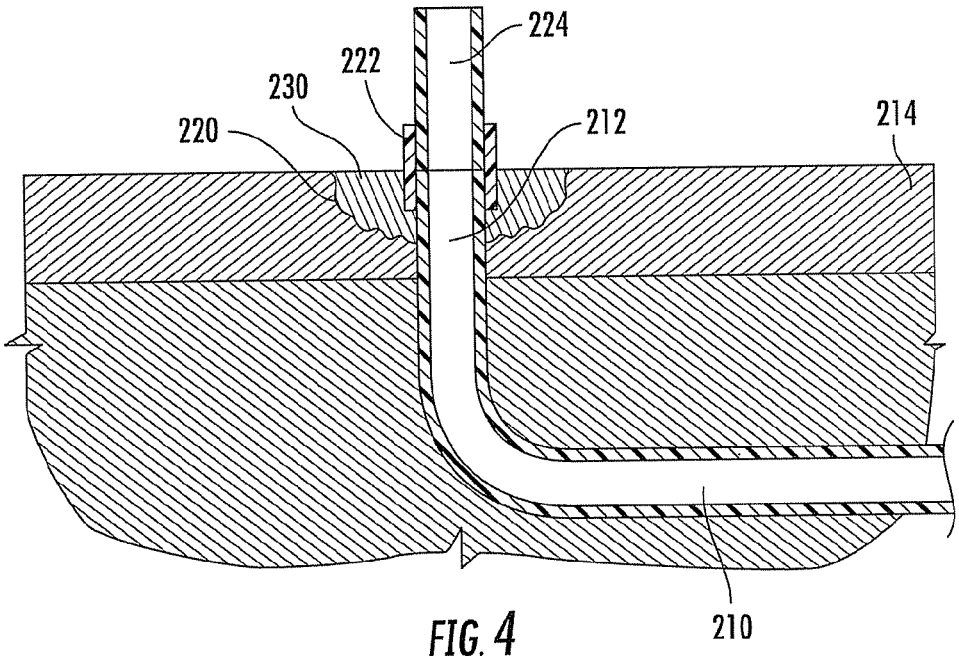
FIG. 4 is a partial sectional view of the conduit of FIG. 1, with a repair applied.
Figure 5:
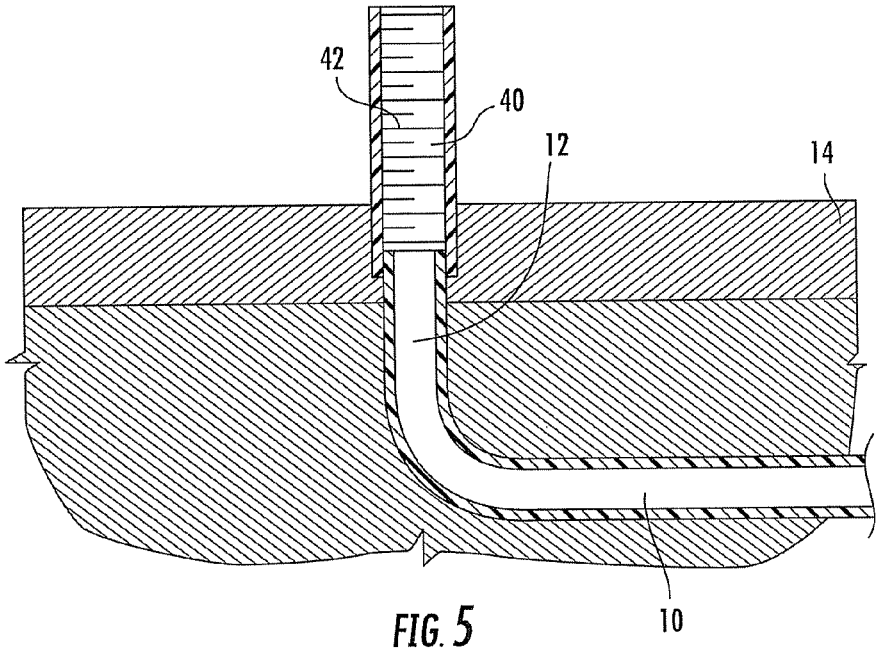
FIG. 5 is a sectional view of conduit with a vertical extension including an elongated adapter, according to an embodiment of the present invention.

Referring to FIG. 5, according to an embodiment of the present invention, a conduit 10 includes an extension 12, with an elongated adapter 40 coupled to the extension 12. Female threads 42 are formed along the inner surface of the elongated adapter 40 above the junction with the extension 12. The conduit 10 and slab 14 are represented generically in the Figures, and nothing in the present application requires a particular conduit 10 geometry or separation from the slab 14.

It will be appreciated that the slab 14 could wholly or partially ensconce the horizontal portion of the conduit 10.

Figure 6:
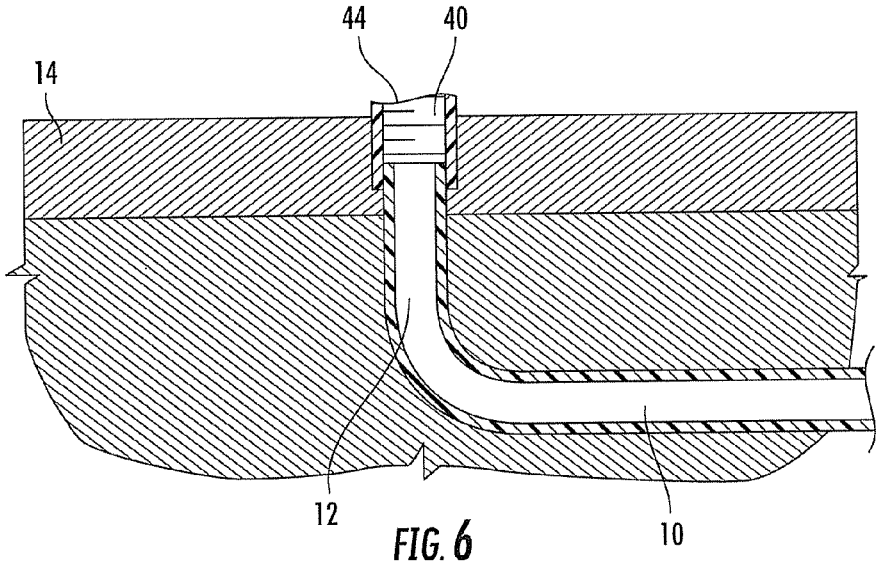
FIG. 6 is a sectional view of the conduit of FIG. 5, with the elongated adapter broken proximate to the slab.
Figure 7:
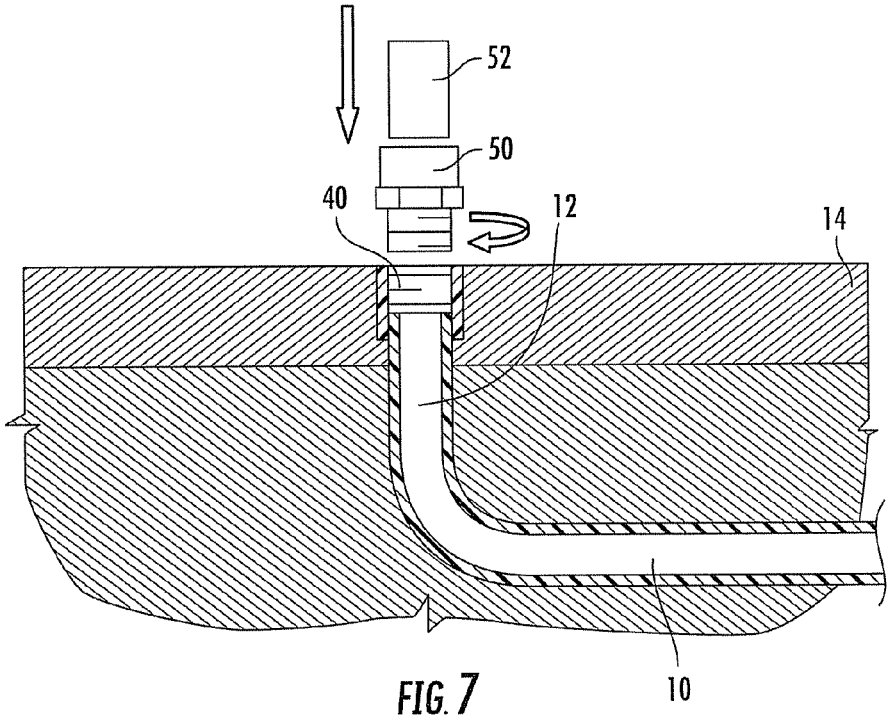
FIG. 7 is a sectional view of the conduit of FIG. 5, with a repair being applied.

Referring to FIG. 6, a break 42, or other damage, has occurred to the elongated adapter 40, for instance, due to impact with a screed. Referring to FIG. 7, the elongated adapter 40 is cut level with the slab 14, and a male adapter 50 is screwed into the remaining threaded length of the elongated adapter 40. A further extension 52 is then coupled to the male adapter 50 (the male adapter 50 and further extension 52 are not shown in section).

It will be appreciated that the use of the elongated adapter 40 on the vertical extension 12 of the conduit 10 effectively eliminates the need to remove concrete from the area around the vertical extension 12. The speed and ease with which the further extension 52 is added, even in the case of a damaged elongated adapter 40, is greatly enhanced.

Figure 8:
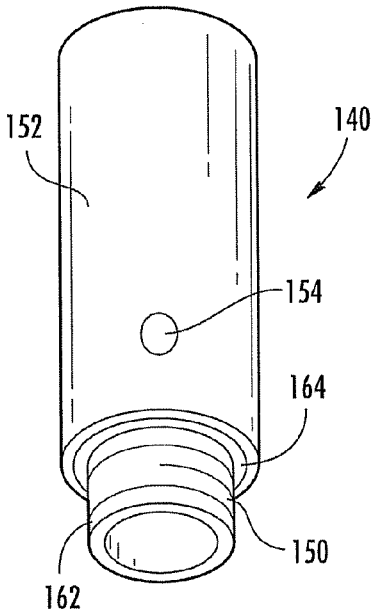
FIG. 8 is a perspective view of a modular adapter, according to another embodiment of the present invention.
Figure 9:
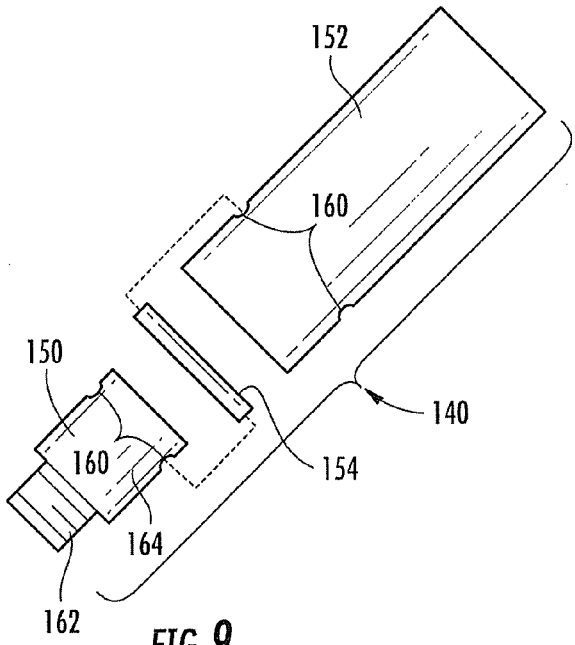
FIG. 9 is an exploded side view of the modular adapter of FIG. 8.

Currently, an elongated adapter, such as the elongated adapter 40, with an extended length female threaded portion, able to be coupled to adjacent conduit, is not a standard conduit component. Thus, custom fabrication of this component may be initially required, at a relatively high cost until economies of scale are developed. Referring to FIGS. 8 and 9, a modular adapter 140, according to another embodiment of the present invention, can be more economically fabricated using mainly commercially-available components.

The modular adapter 140 includes an adapter element 150 coupled with an elongated element 152 by a retention element 154. The retention element 154 is disposed through aligned openings 160 in walls of the adapter element 150 and elongated element 152.

The adapter element 150 preferably includes a male-threaded portion 162 extending from a coupling portion 164. The elongated element 152 is preferably formed from a length of readily-available pipe (e.g., Schedule 40 PVC) dimensioned to closely accommodate the coupling portion 164 therein. A pin may advantageously be used for the retention element 154.

Figure 10:
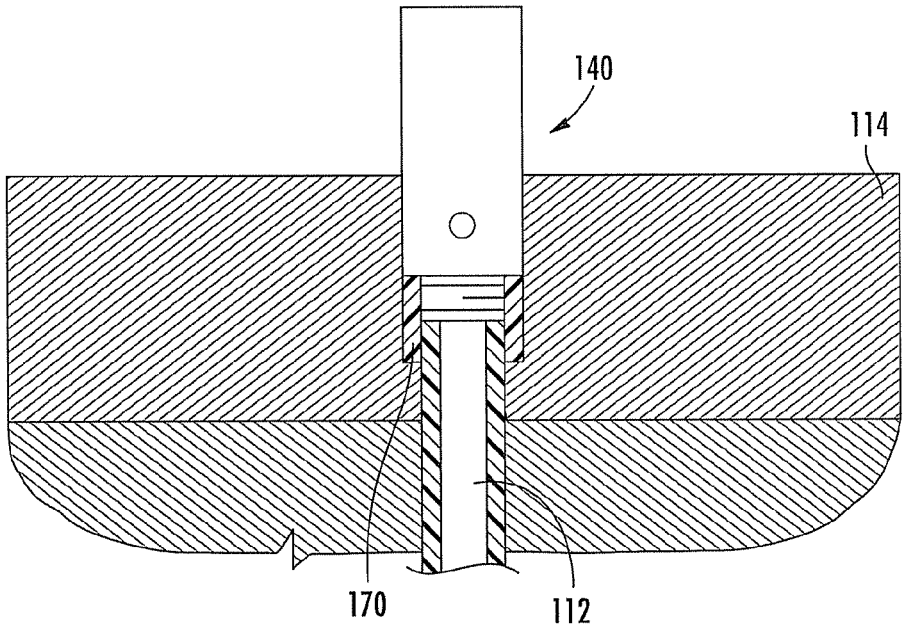
FIG. 10 is a sectional view of a slab and a vertical extension, with the modular adapter of FIG. 8 attached to the vertical extension.

The use of the modular adapter 140 to facilitate a repair will be described with reference to FIGS. 10-12 (the modular adapter is not shown in section in FIGS. 10-12). Referring to FIG. 10, the modular adapter 140 is attached to a female adapter 170 coupled to a vertical extension 112. A slab 114 surrounds the junction between the female adapter 170 and the modular adapter 140.

Figure 11:
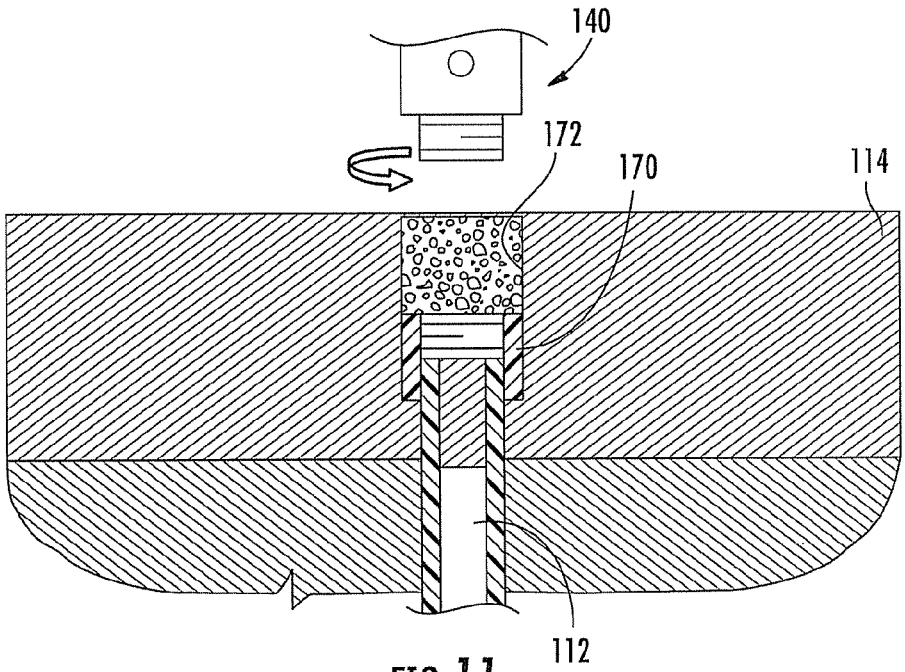
FIG. 11 is a sectional view of the slab and vertical extension of FIG. 10, with the modular adapter of FIG. 8 broken and detached from the vertical extension.
Figure 12:
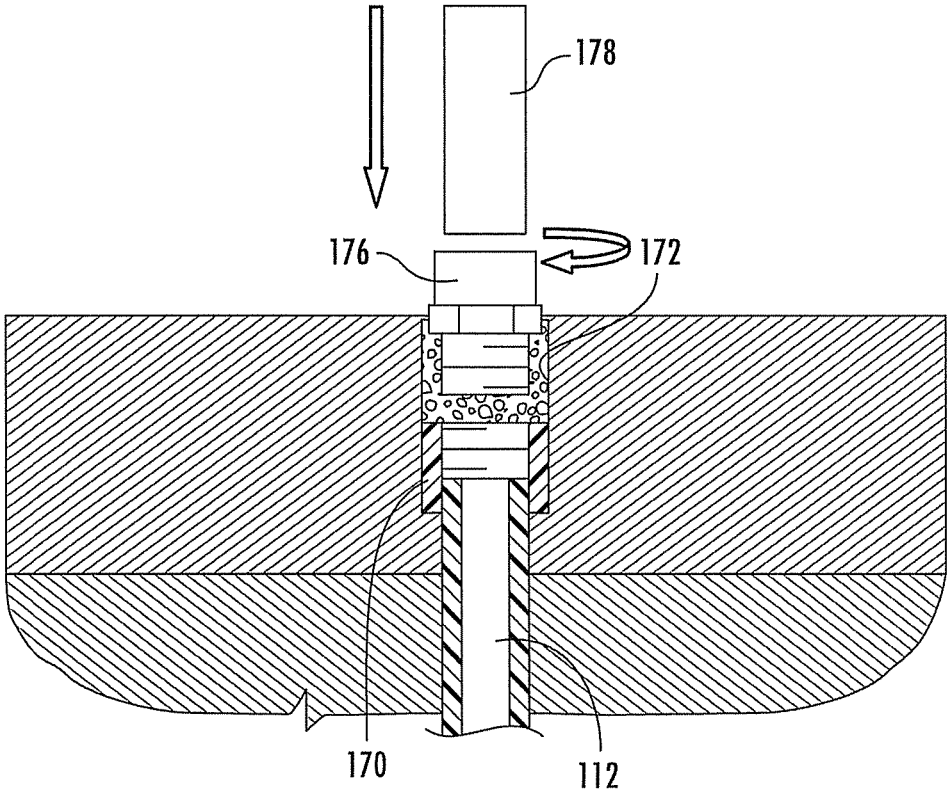
FIG. 12 is a sectional view of the slab and vertical extension of FIG. 10, with a repair being applied.

Referring to FIG. 11, the modular adapter 140 is broken and is removed by unscrewing from the female adapter 170, leaving an open area 172 above the female adapter 170. Referring to FIG. 12, a male adapter 176 is threaded into the female adapter 170 within the open area 172 left by removal of the modular adapter 140. Preferably, the open area 172 is of sufficient diameter to allow a tool to engage hex- or other tool engagement surfaces of the male adapter 176. A further extension 178 is coupled to the male adapter 176.

The above-described embodiments are provided for illustrative and exemplary purposes; the present invention is not necessarily limited thereto. Instead, those skilled in the art will appreciate that various modifications and adaptations to particular circumstances are possible within the scope of the present invention.

For instance, although PVC is a preferred material, the present invention is not necessarily limited thereto. Additionally, conduit, elongated adapters and modular adapters can be readily dimensioned based on the requirements of a particular job, as well as local code requirements (for instance, code requirements governing the required schedule and diameter of conduit, its placement, and extension above the poured slab).

The following modular adapter dimensions have been found suitable for many electrical building code requirements. The adapter element 150 can have ¾" electrical threaded portion 16 that is 2½" in length. The coupling portion 150 can be 1" in length with a 1¼" outside diameter. The elongated element 152 can be 4" to 6" in length and formed from 1⅝" diameter Schedule 40 PVC pipe.

Although the use of threaded male and/or female adapters is advantageous, the present invention not necessarily limited to male and/or female adapters with threaded fittings.

Also, although particularly advantageous in connection with service conduit extending through foundation slabs, the present invention is not necessarily limited to such an application. The present invention can also be applied to conduits extending through other barriers, including barriers oriented non-horizontally.

The foregoing is not an exhaustive list. Rather, those skilled in the art will appreciate that these and other modifications and adaptations are possible within the scope of the invention as herein shown and described and of the claims appended hereto.

What is claimed is:

1. A method of routing conduit through a poured concrete slab, the method comprising:

before the slab is poured:

positioning a conduit extension such that the extension will extend into the slab when poured;

connecting a first adapter with female threads to the conduit extension such that an upper end of the first adapter will be located within the slab when poured;

connecting a second adapter with male threads to the female threads of the first adapter such that an upper end of the second adapter will extend above the slab when poured; and after the slab is poured:

removing the second adapter so as to leave the female threads of the first adapter accessible at a position recessed within the slab.

2. The method of claim 1, wherein the second adapter is a modular adapter including an adapter element with a male threaded portion and a coupling portion and an elongated element surrounding and coupled to the coupling portion, the elongated element dimensioned to extend above the slab when poured.

3. The method of claim 2, wherein the elongated element is coupled to the coupling portion by a retention element extending through the elongated element and the coupling portion.

4. The method of claim 3, wherein the second adapter is positioned such that the retention element will be located within the slab.

* * * * *